US010233617B1

(12) United States Patent
He

(10) Patent No.: US 10,233,617 B1
(45) Date of Patent: Mar. 19, 2019

(54) QUICK CONNECT FAUCET

(71) Applicant: Globe Union Industrial Corp., Taichung (TW)

(72) Inventor: Kaizhong He, Shen Zen (CN)

(73) Assignee: Globe Union Industrial Corp., Taichung (TW)

( * ) Notice: Subject to any disclaimer, the term of this patent is extended or adjusted under 35 U.S.C. 154(b) by 0 days.

(21) Appl. No.: 15/801,452

(22) Filed: Nov. 2, 2017

(51) Int. Cl.
*E03C 1/02* (2006.01)
*E03C 1/04* (2006.01)

(52) U.S. Cl.
CPC ..... *E03C 1/021* (2013.01); *E03C 1/0404* (2013.01); *E03C 2001/026* (2013.01); *Y10T 137/9464* (2015.04)

(58) Field of Classification Search
None
See application file for complete search history.

(56) References Cited

U.S. PATENT DOCUMENTS

2015/0198259 A1* 7/2015 Lin ..... F16K 19/006 137/603
2016/0376775 A1* 12/2016 Tasserit ..... E03C 1/0403 137/801

FOREIGN PATENT DOCUMENTS

CN 201339745 Y 11/2009
CN 205908827 U 1/2017

* cited by examiner

*Primary Examiner* — Robert K Arundale
*Assistant Examiner* — Daphne M Barry
(74) *Attorney, Agent, or Firm* — Alan D. Kamrath; Kamrath IP Lawfirm, P.A.

(57) ABSTRACT

A quick connect faucet contains: a hollow body, a control valve assembly, and a water supply set. The hollow body includes a longitudinal chamber and a channel, the longitudinal chamber has an accommodation groove having a fixing orifice and a first stepped. The control valve assembly includes a holder having a first locking rib, a cold-water conduit, a hot-water conduit, a mixing-water conduit, a bottom fence, and a fastener. The cold-water conduit has a cold-water inlet having a hot-water inlet, the bottom fence has at least one locking protrusion, and the fastener has at least two cutouts. The water supply set includes a cold-water inflow tube and a hot-water inflow tube, each of which has an outlet segment, wherein the outlet segment of the cold-water inflow tube has a peripheral trench, and the outlet segment of the hot-water inflow tube has a peripheral trench.

13 Claims, 20 Drawing Sheets

QUICK CONNECT FAUCET

FIELD OF THE INVENTION

The present invention relates to a faucet, and more particularly to a quick connect faucet.

BACKGROUND OF THE INVENTION

A conventional basin faucet or pull-out faucet is mounted contains a hollow body, a control valve assembly, and a water supply set. The hollow body includes a holder, a mixing valve, an affix loop, a cap, and a handle. The holder is housed in an accommodation groove of the holder and is connected with the mixing valve, the affix loop, the cap, and the handle. The water supply set includes a cold-water inflow tube and a hot-water inflow tube which are housed in the holder. The water supply set further includes a mixing-water outflow tube coupling with a water hose which is in connection with a spray head on an outlet segment of the hollow body, hence the spray head is pulled out of the water hose, and the water hose has a counterweight configured to return the spray head back to the outlet segment of the hollow body, after pull the spray head.

However, the holder is made of metal material to cause high fabrication cost, rust, and metal pollution. Furthermore, the water supply set is screwed with the holder by using a hand tool.

To avoid above-mentioned problems, a plastic control valve of a faucet is disclosed in CN Patent Publication No. 201339745, and an inflow tube and an outflow tube are fixed on the bottom of the control valve by way of a screw bolt and a stop disc. Nevertheless, when the screw bolt loosens after a period of using time, the inflow tube and the outflow tube can be removed from the control valve easily.

A fixing structure of a faucet is disclosed in CN Patent Publication No. 205908827 and contains a plastic holder configured to accommodate an inlet tube and an outlet tube which are secured on a bottom of the holder by using a stop piece. However, the holder has two threaded orifices configured to screw with two screw bolts by way of the stop piece, thus having a high manufacture cost and allowing easy removal of the inlet tube and the outlet tube.

The present invention has arisen to mitigate and/or obviate the afore-described disadvantages.

SUMMARY OF THE INVENTION

The primary aspect of the present invention is to provide a quick connect faucet in which the fastener slidably retains with the holder so as to fix the water supply set with the holder easily without using any screw bolts or a rotatory tool, after the water supply set of the quick connect faucet is inserted into the holder.

Another aspect of the present invention is to provide a quick connect faucet which contains the holder integrally injection molded from plastic material so as to reduce fabrication cost and to avoid lead remaining in the quick connect faucet.

To obtain the above aspects, a quick connect faucet provided by the present invention contains: a hollow body, a control valve assembly, and a water supply set.

The hollow body includes a longitudinal chamber defined in the hollow body, and the hollow body includes a channel communicating with the longitudinal chamber. The longitudinal chamber has an accommodation groove, and the accommodation groove has a fixing orifice and a first stepped portion radially extending around an inner wall of the accommodation groove.

The control valve assembly includes a holder integrally injection molded from plastic material and accommodated in the accommodation groove from the fixing orifice, and the holder has a first locking rib extending outwardly around an outer wall thereof so as to retain with the first stepped portion, a cold-water conduit configured to flow cold water, a hot-water conduit configured to flow hot water, and a mixing-water conduit configured to flow mixing water of the cold water and the hot water, a bottom fence formed on a bottom of the holder. The cold-water conduit has a cold-water inlet defined on the bottom fence, the hot-water conduit has a hot-water inlet formed on the bottom fence, and the bottom fence has at least one locking protrusion extending therefrom; the control valve assembly includes a fastener slidably retaining with the at least one locking protrusion, wherein the fastener has at least two cutouts.

The water supply set includes a cold-water inflow tube and a hot-water inflow tube, each of the cold-water inflow tube and the hot-water inflow tube having an outlet segment, wherein an outlet segment of the cold-water inflow tube is inserted into the cold-water inlet, and an outlet segment of the hot-water inflow tube is inserted into the hot-water inlet. The outlet segment of the cold-water inflow tube has a peripheral trench defined on an outer wall thereof; and the outlet segment of the hot-water inflow tube has a peripheral trench defined on an outer wall thereof hence the peripheral trenches of the cold-water inflow tube and the hot-water inflow tube retain with the at least two cutouts of the fastener respectively so as to fix the cold-water inflow tube and the hot-water inflow tube with the holder.

DETAILED DESCRIPTION OF THE PREFERRED EMBODIMENTS

Figure 1:
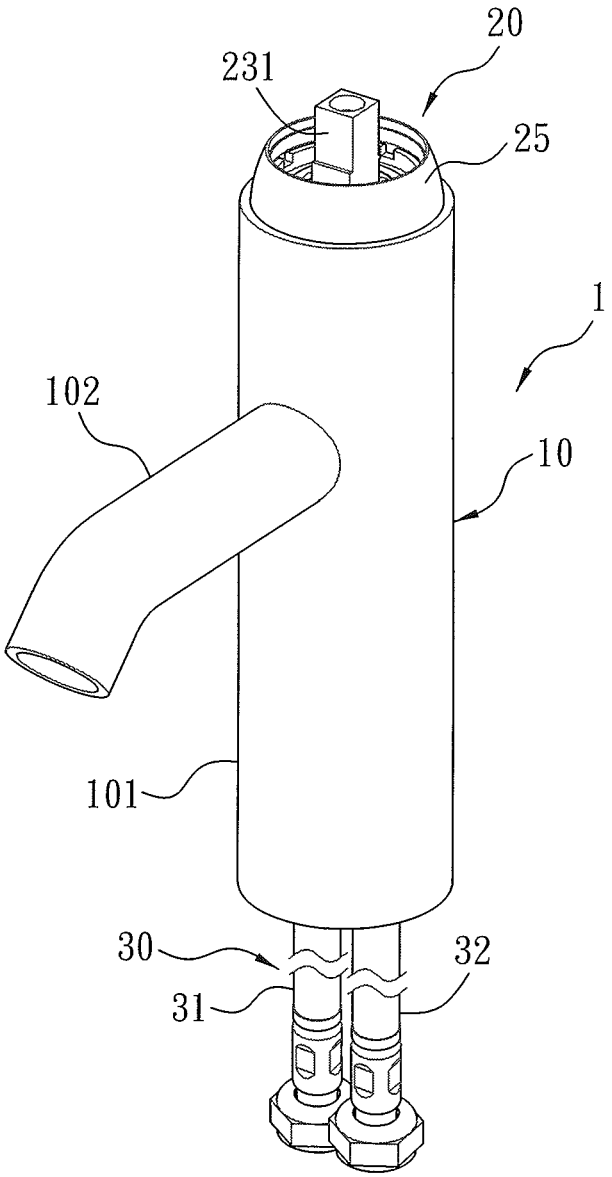
FIG. 1 is a perspective view showing the assembly of a part of quick connect faucet according to a first embodiment of the present invention.
Figure 2:
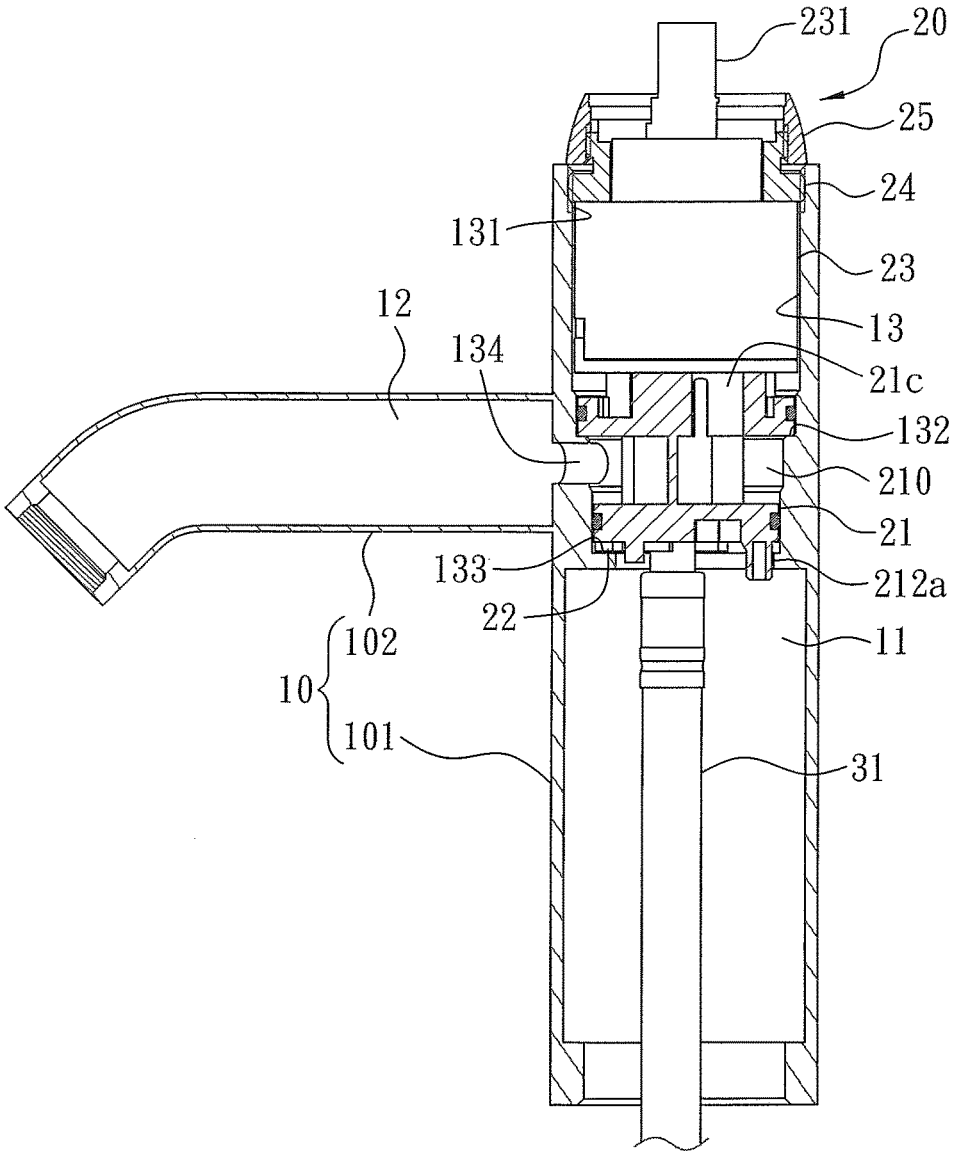
FIG. 2 is a cross sectional view showing the assembly of a part of the quick connect faucet according to the first embodiment of the present invention.
Figure 3:
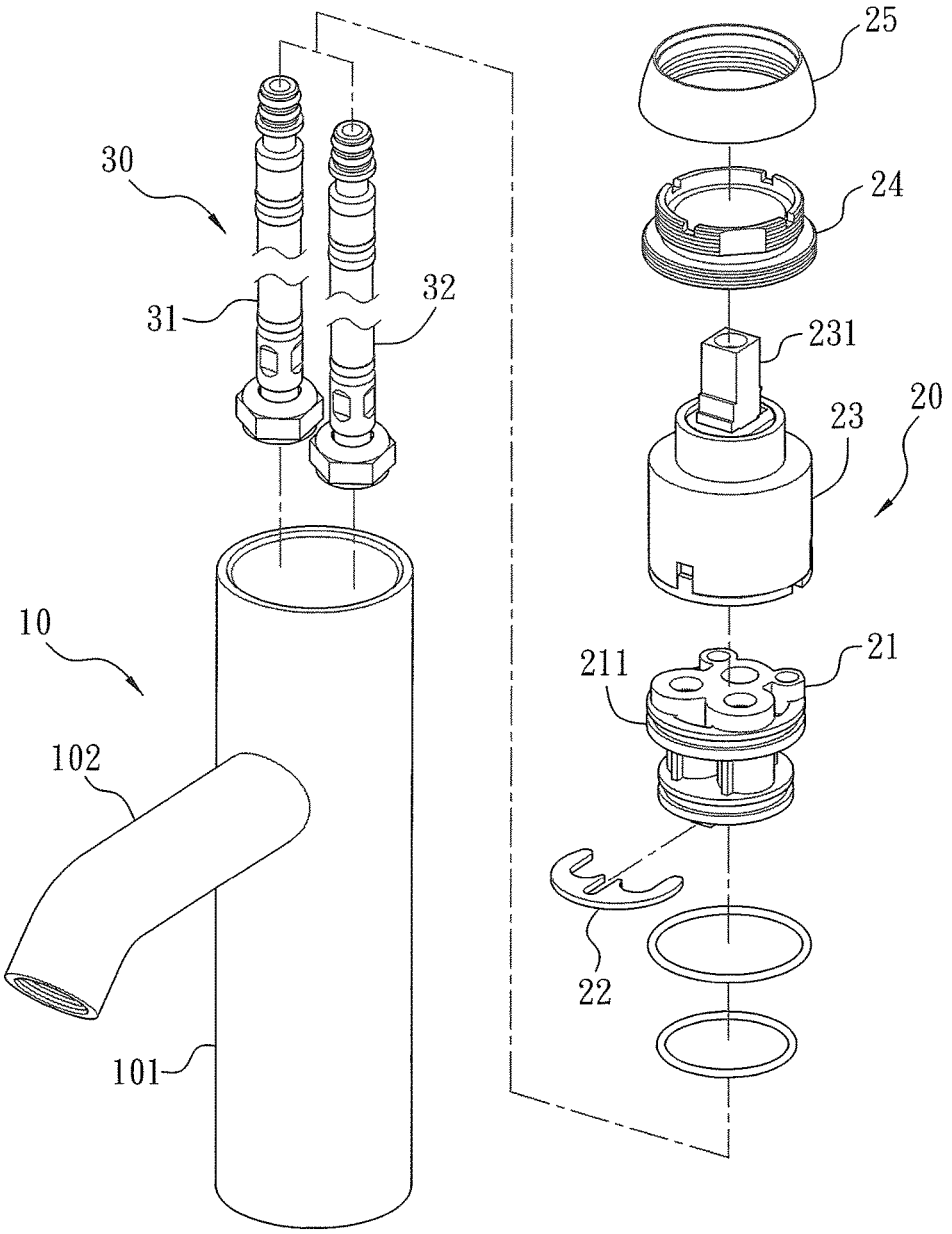
FIG. 3 is a perspective view showing the exploded components of a part of the quick connect faucet according to the first embodiment of the present invention.

With reference to FIGS. 1-3, a quick connect faucet 1 according to a first embodiment of the present invention is mounted on a basin and comprises: a hollow body 10, a control valve assembly 20, and a water supply pipe set 30.

Figure 4:
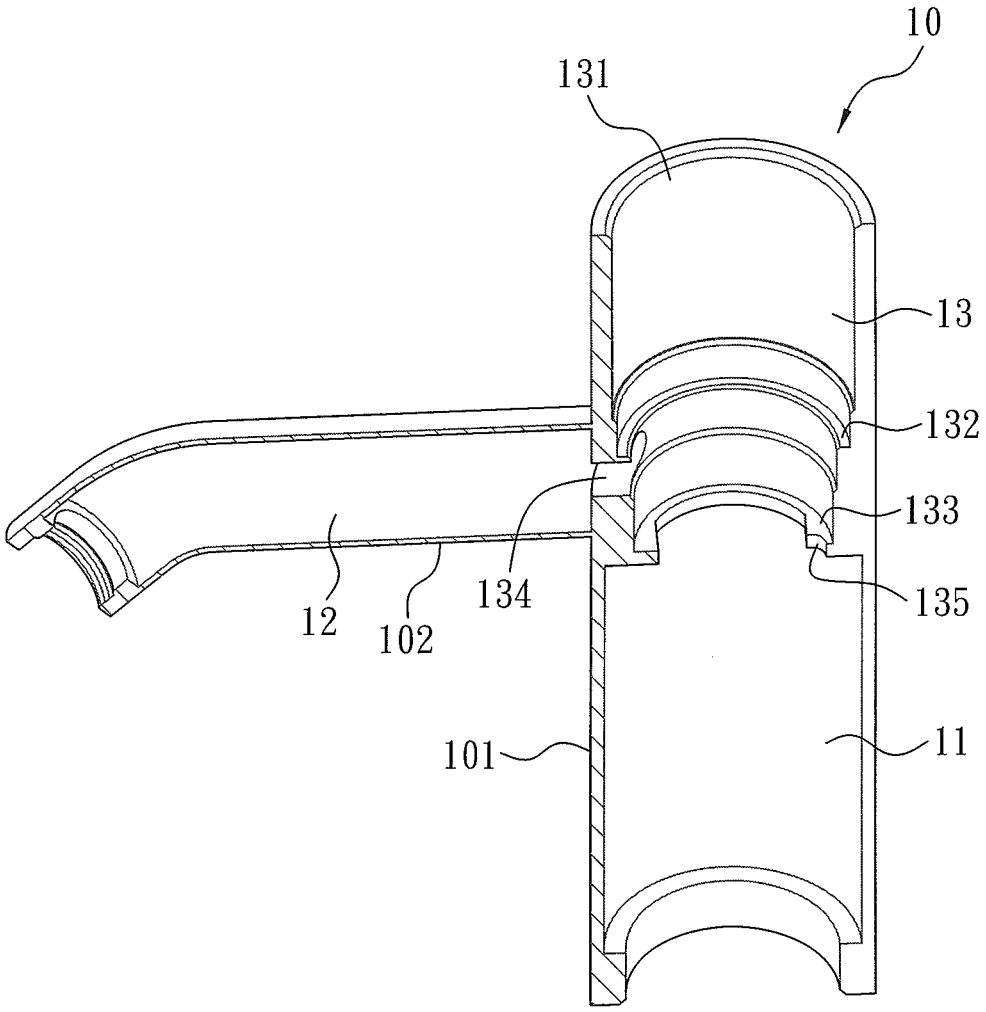
FIG. 4 is a cross-sectional perspective view showing the assembly of a part of the quick connect faucet according to the first embodiment of the present invention.
Figure 5:
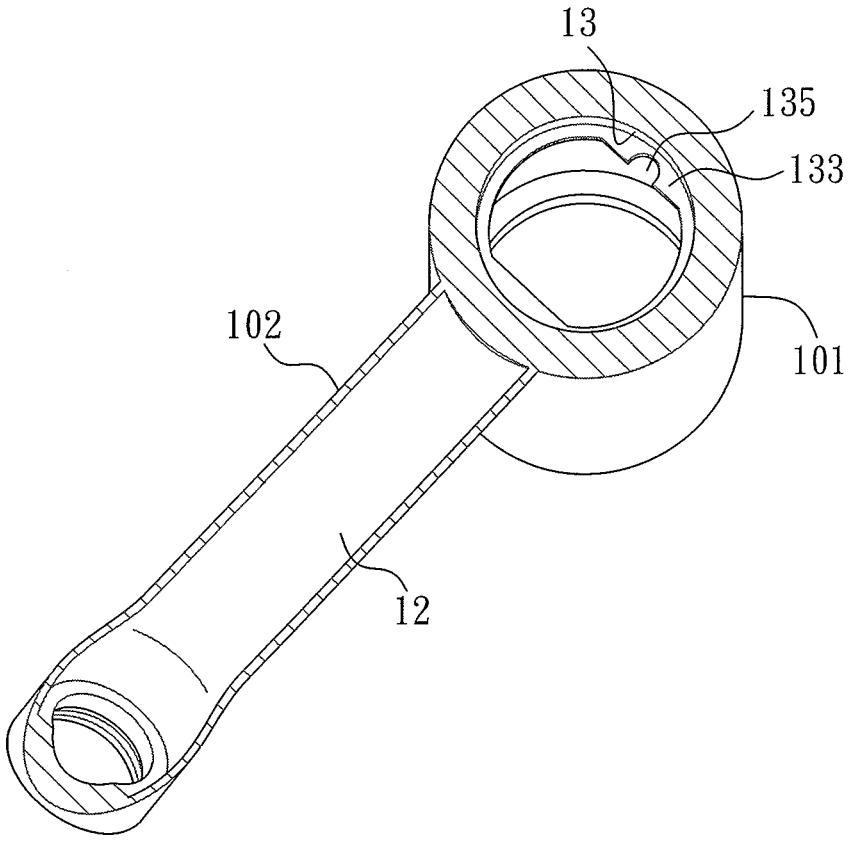
FIG. 5 is another cross-sectional perspective view showing the assembly of a part of the quick connect faucet according to the first embodiment of the present invention.
Figure 6:
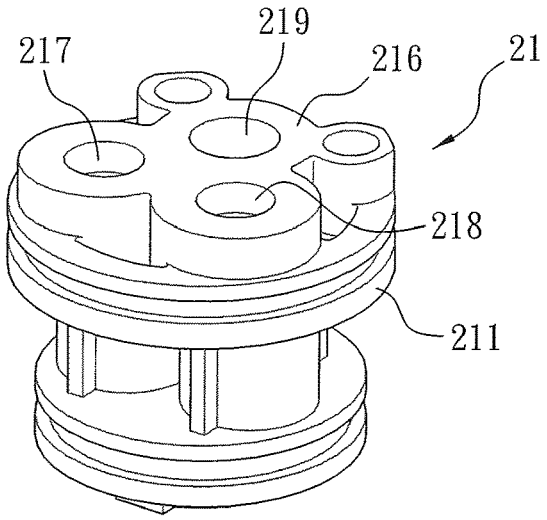
FIG. 6 is another perspective view showing the assembly of a part of quick connect faucet according to the first embodiment of the present invention.

Referring to FIGS. 4 and 5, the hollow body 10 includes a longitudinal chamber 11 defined therein and includes a channel 12 communicating with the longitudinal chamber 11; the longitudinal chamber 11 has an accommodation groove 13 formed therein, and the accommodation groove has 13 has a fixing orifice 131 and a first stepped portion 132 radially extending around an inner wall of the accommodation groove 13.

As shown in FIGS. 6-9, the control valve assembly 20 includes a holder 21 integrally injection molded from plastic material and accommodated in the accommodation groove 13 from the fixing orifice 131, as illustrated in FIG. 2, and the holder 21 has a first locking rib 211 extending outwardly around an outer wall thereof so as to retain with the first stepped portion 132, a cold-water conduit 21*a* configured to flow cold water, a hot-water conduit 21*b* configured to flow hot water, a mixing-water conduit 21*c* configured to flow mixing water of the cold water and the hot water, and a bottom fence 212 formed on a bottom of the holder 21, wherein the cold-water conduit 21*a* has a cold-water inlet 213 defined on the bottom fence 212, the hot-water conduit 21*b* has a hot-water 214 formed on the bottom fence 212, and the bottom fence 212 has at least one locking protrusion 215 extending therefrom. As shown in FIG. 10-22, the control valve assembly 20 includes a fastener 22 slidably retaining with the at least one locking protrusion 215, wherein the fastener 22 has at least two cutouts 221.

Figure 10:
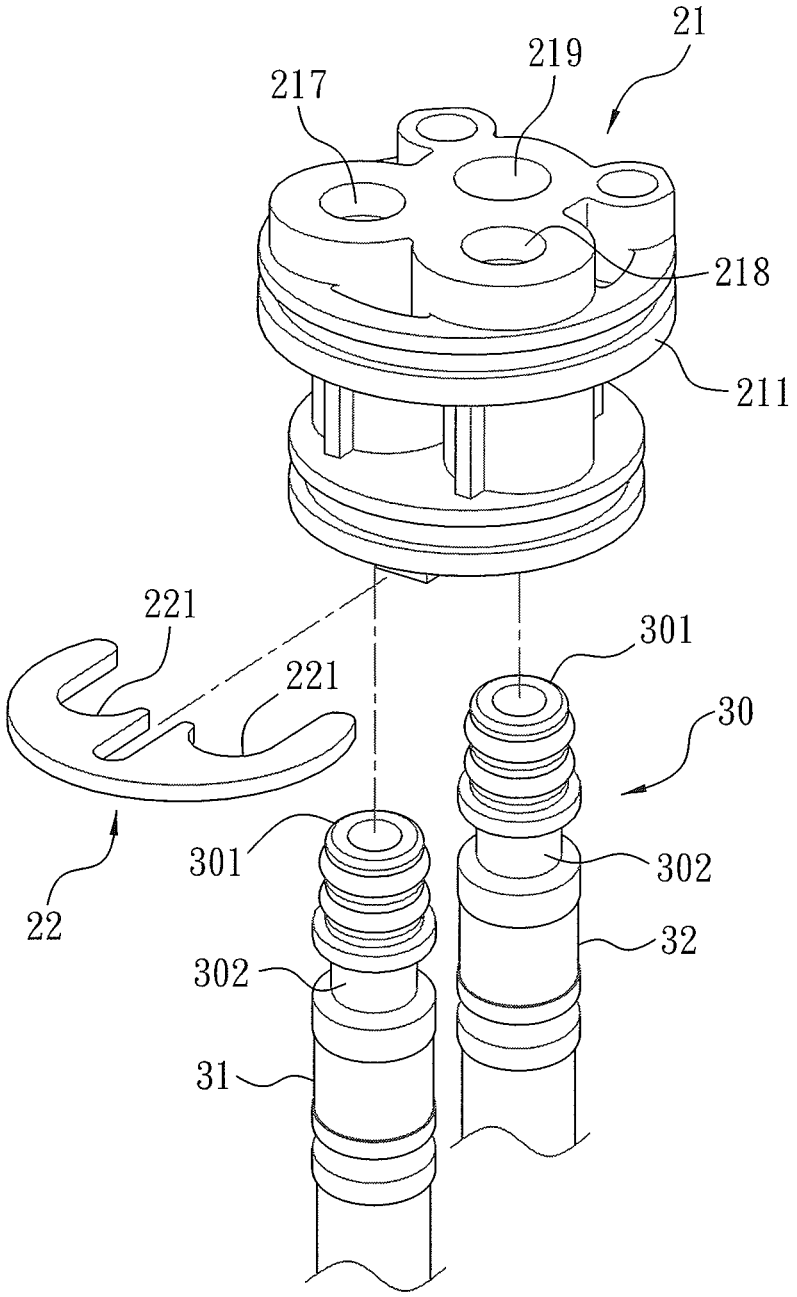
FIG. 10 is another perspective view showing the exploded components of a part of the quick connect faucet according to the first embodiment of the present invention.
Figure 11:
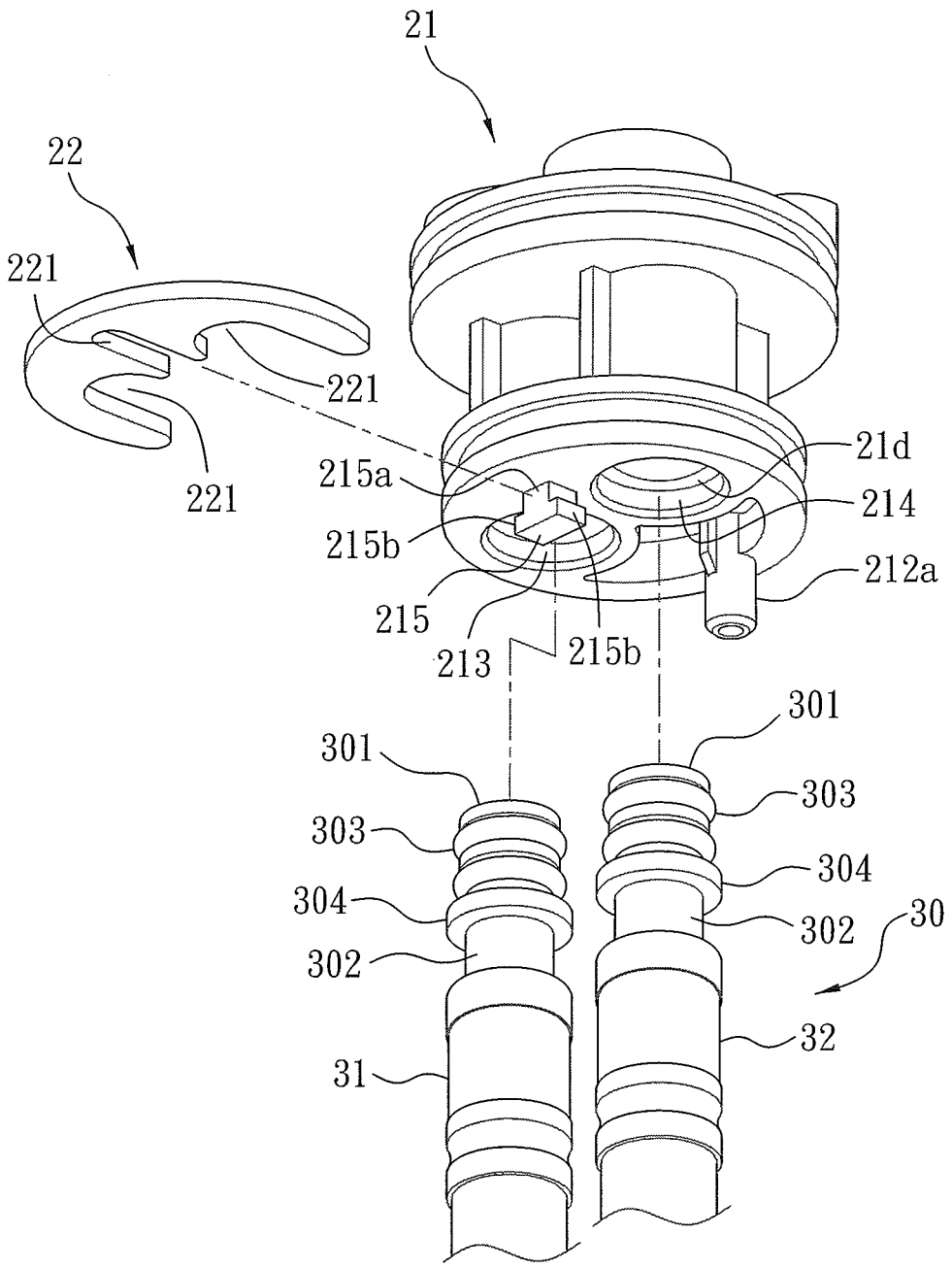
FIG. 11 is also another perspective view showing the exploded components of a part of the quick connect faucet according to the first embodiment of the present invention.
Figure 12:
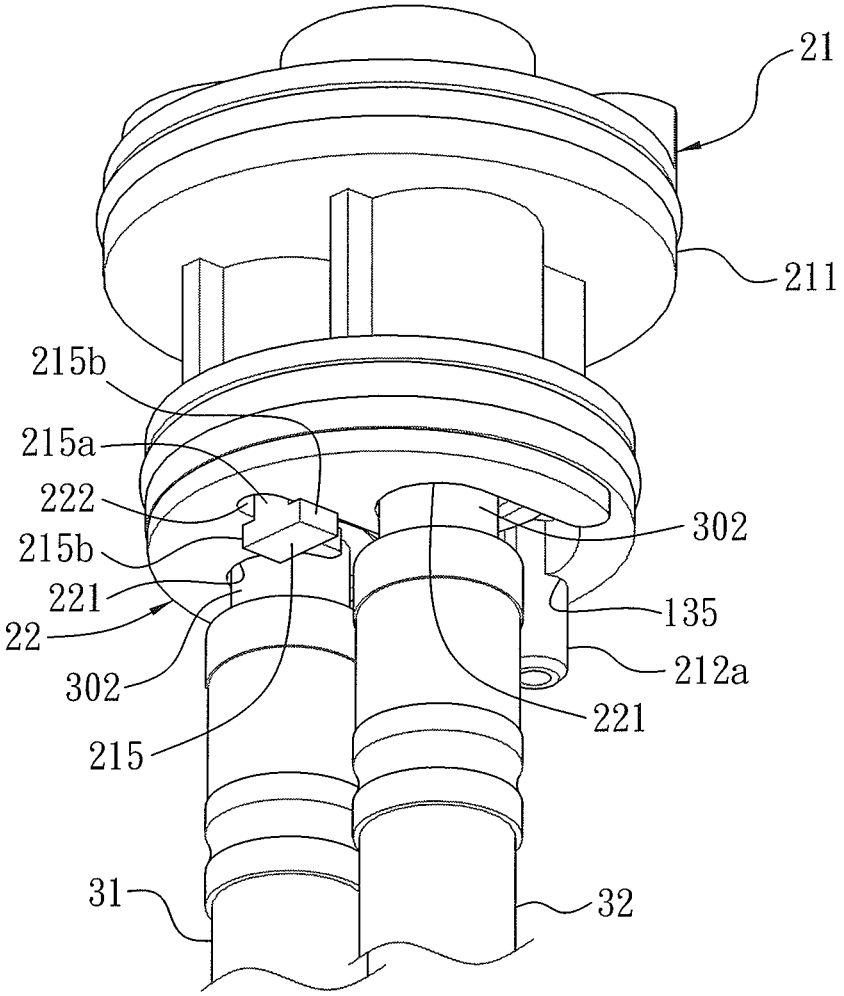
FIG. 12 is another perspective view showing the assembly of a part of the quick connect faucet according to the first embodiment of the present invention.

With reference to FIGS. 10-12, the water supply set 30 includes a cold-water inflow tube 31 and a hot-water inflow tube 32, each of the cold-water inflow tube 31 and the hot-water inflow tube 32 has an outlet segment 301, wherein an outlet segment 301 of the cold-water inflow tube 31 is inserted into the cold-water inlet 213, and an outlet segment 301 of the hot-water inflow tube 32 is inserted into the hot-water inlet 214, wherein the outlet segment 301 of the cold-water inflow tube 31 has a peripheral trench 302 defined on an outer wall thereof and the outlet segment 301 of the hot-water inflow tube 32 has a peripheral trench 302 defined on an outer wall thereof hence the peripheral trenches 302 of the cold-water inflow tube 31 and the hot-water inflow tube 32 retain with the at least two cutouts 221 of the fastener 22 respectively so as to fix the cold-water inflow tube 31 and the hot-water inflow tube 32 with the holder 21.

Referring to FIGS. 1-3, the control valve assembly 20 further includes a mixing valve 23, an affix loop 24, a cap 25, and a handle (not shown). The mixing valve 23 is housed in the accommodation groove 13 from the fixing orifice 131 and communicates with the holder 21, and the mixing valve 23 has a rotary shaft 231. The affix loop 24 is screwed with the fixing orifice 131 of the hollow body 10 so as to fix the mixing valve 23 in the accommodation groove 13. The cap 25 covers the fixing orifice 131, and the handle is connected with the rotary shaft 231 of the mixing valve 23.

As shown in FIGS. 4 and 5, the accommodation groove 13 further has a second stepped portion 133 radially extending around the inner wall thereof away from the affix orifice 131. The fastener 22 is opposite to the second stepped portion 133 and is limited by the second stepped portion 133.

As illustrated in FIGS. 6-9, the holder 21 has a top fence 216 defined on a top thereof, wherein the cold-water conduit 21*a* has a first outlet 217 formed on the top fence 216, the hot-water conduit 21*b* has a second outlet 217 formed on the top fence 216, and the mixing-water conduit 21*c* has a third outlet 218 formed on the top fence 216. Preferably, the mixing-water conduit 21*c* has at least two fourth outlets 210 formed on an outer wall of the holder 21.

With reference to FIGS. 7 and 11-13, the bottom fence 212 of the holder 21 has a T-shaped locking protrusion 215 extending from a central position of the bottom fence 212 and located adjacent to the cold-water inlet 213 and the hot-water inlet 214, wherein the T-shaped locking protrusion 215 has a connection portion 215*a* extending downwardly therefrom and has two stop portions 215 extending horizontally from two sides of a distal end of the connection portion 215*a* respectively.

The fastener 22 has a central slot 222 configured to slidably fit with the connection portion 215*a* of the T-shaped locking protrusion 215, and the fastener 22 is stopped by the two stop portions 215*b* so as to fix with the fastener. The at least two cutouts 221 are concaved and located on two sides of the central slot 222 respectively so as to retain with the peripheral trenches 302 of the cold-water inflow tube 31 and the hot-water inflow tube 32.

Referring to FIG. 4, the hollow body 10 includes a cylindrical casing 101 and an outflow tube 102 extending outwardly from an outer wall of the cylindrical casing 101; the cylindrical casing has the longitudinal chamber 11 and the accommodation groove 13; the outflow tube 102 has the channel 12. The cylindrical casing 101 has a through orifice 134 formed on an inner wall thereof opposite to the accommodation groove 13 and communicating with the at least two fourth outlets 210, as shown in FIG. 2, so as to guide the mixing water to the channel 12.

Figure 7:
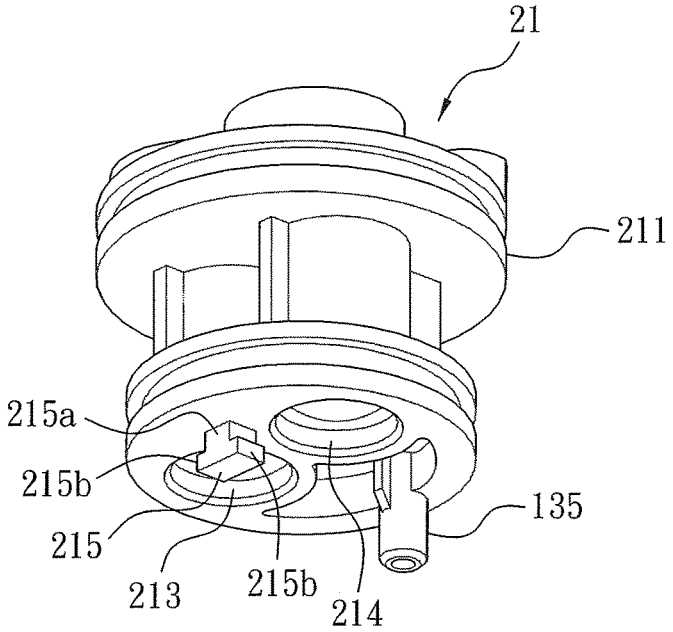
FIG. 7 is also another perspective view showing the assembly of a part of quick connect faucet according to the first embodiment of the present invention.
Figure 13:
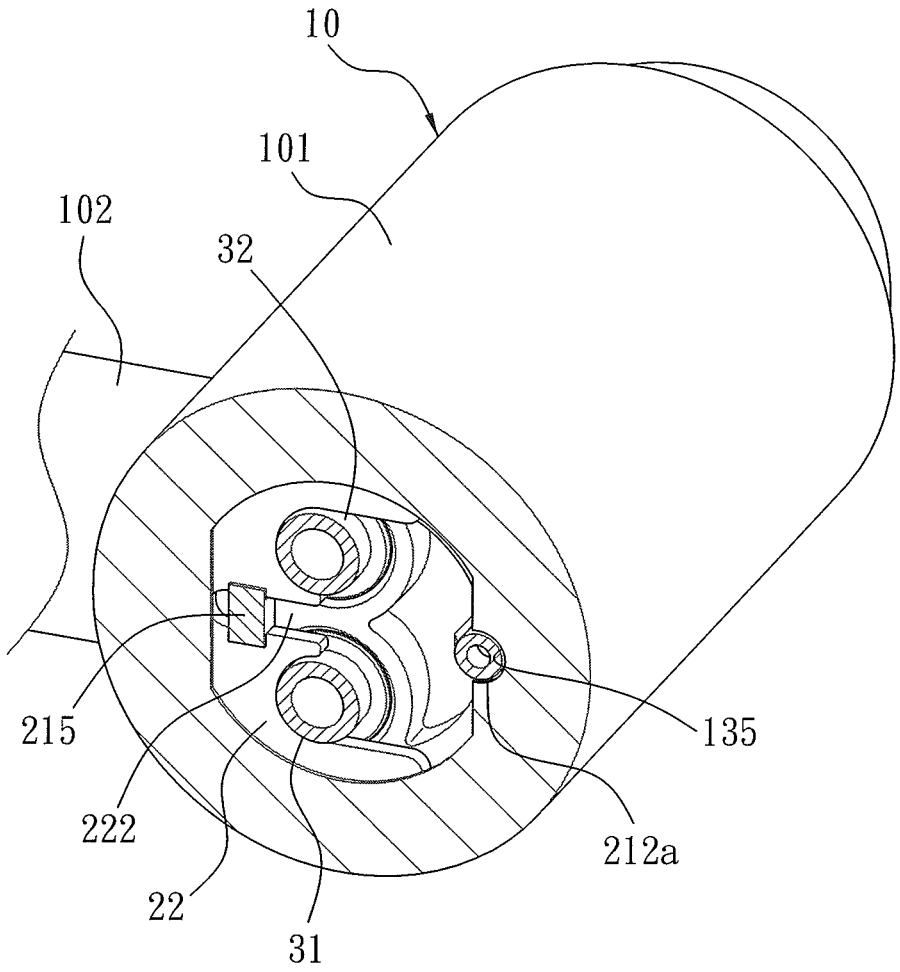
FIG. 13 is a cross-sectional perspective view showing the assembly of a part of the quick connect faucet according to the first embodiment of the present invention.
Figure 14:
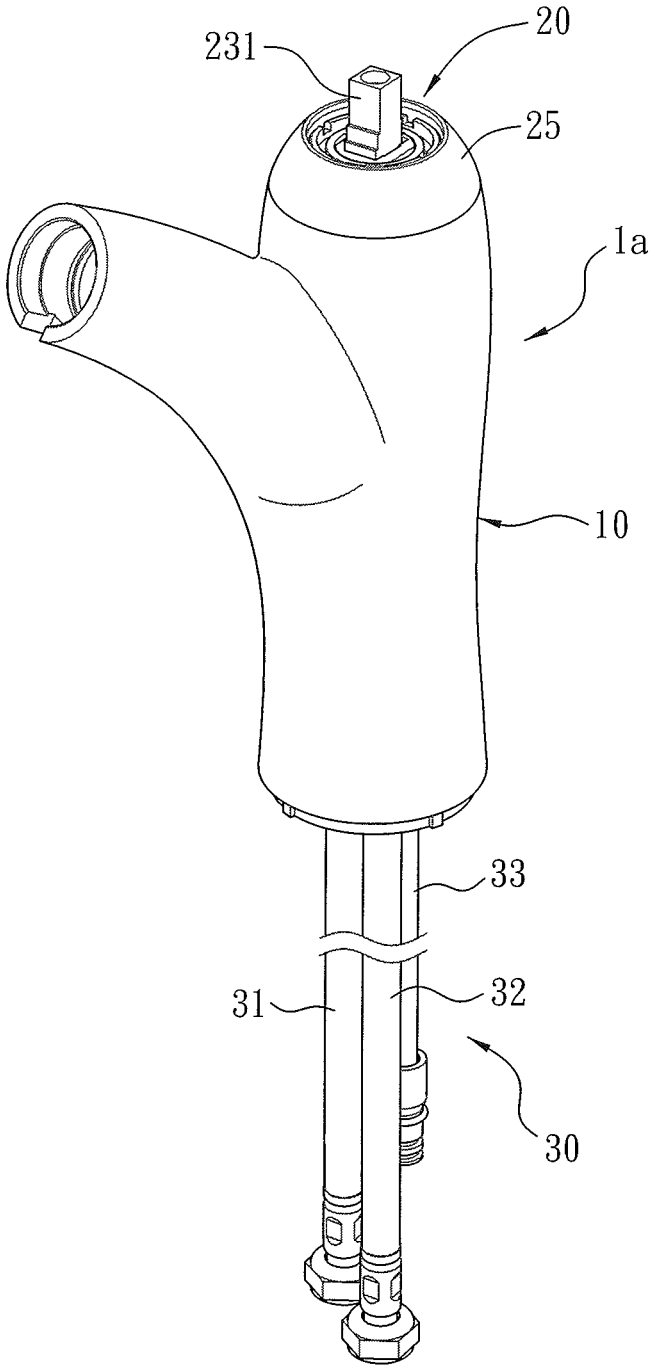
FIG. 14 is a perspective view showing the assembly of a part of quick connect faucet according to a second embodiment of the present invention.
Figure 15:
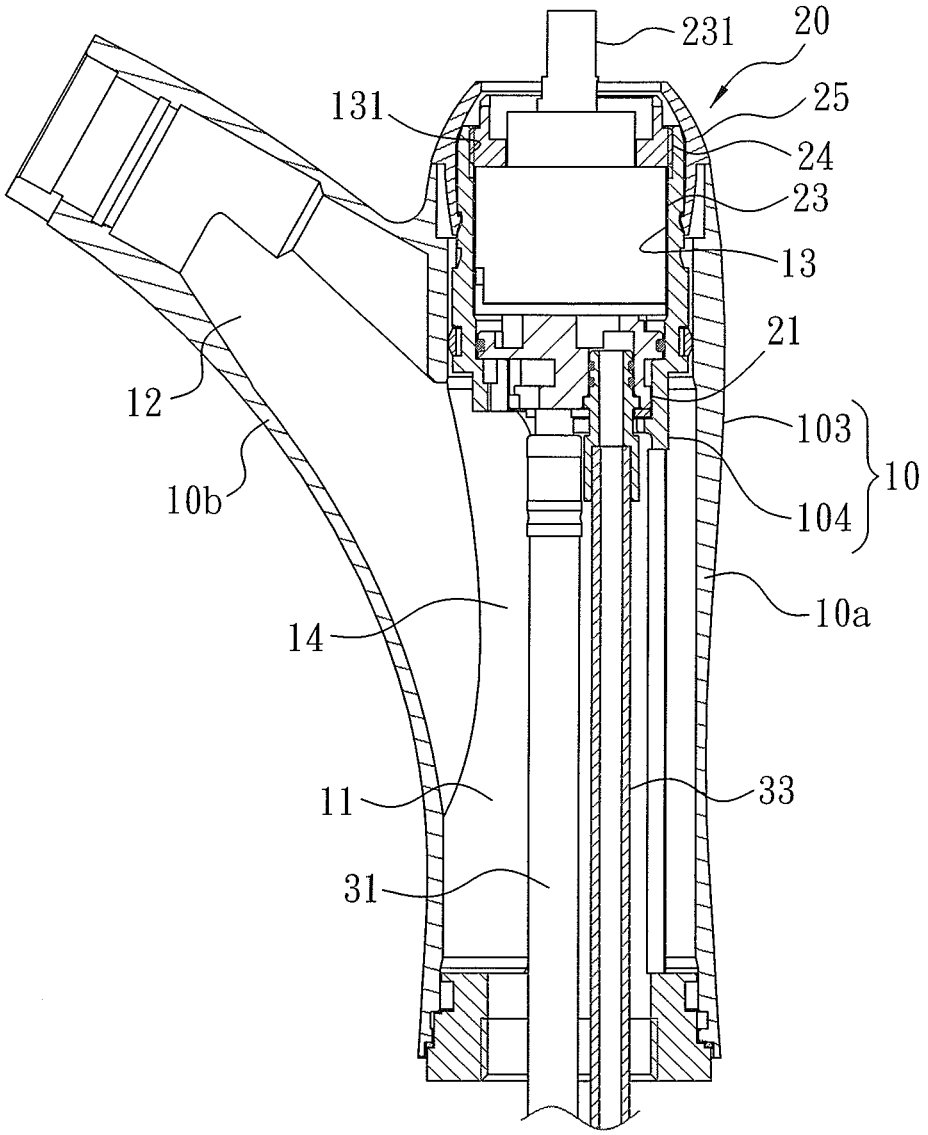
FIG. 15 is a cross sectional view showing the assembly of a part of the quick connect faucet according to the second embodiment of the present invention.
Figure 16:
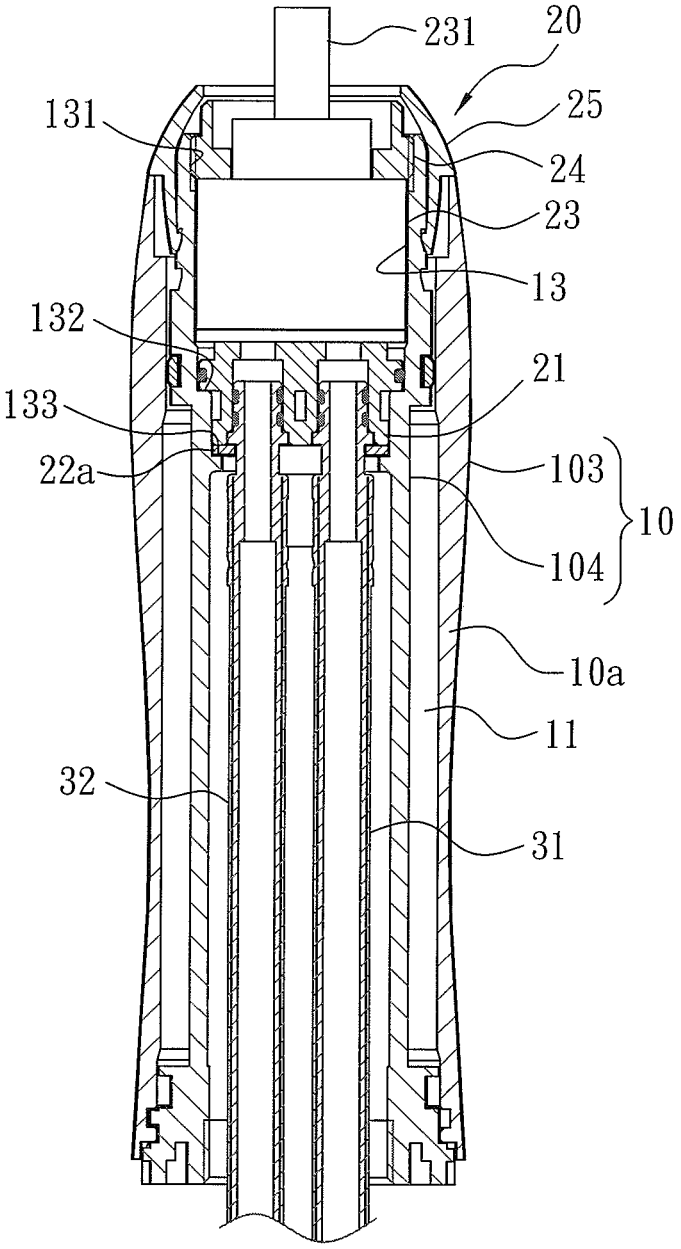
FIG. 16 is another cross sectional view showing the assembly of a part of the quick connect faucet according to the second embodiment of the present invention.

As illustrated in FIGS. 4 and 5, the second stepped portion 133 has a guide orifice 135 formed thereon. The bottom fence 212 of the holder 21 has a column 212*a* extending outwardly therefrom and retained in the guide orifice 135 so as to fix the holder 21, as shown in FIGS. 7, 12, and 13.

Figure 8:
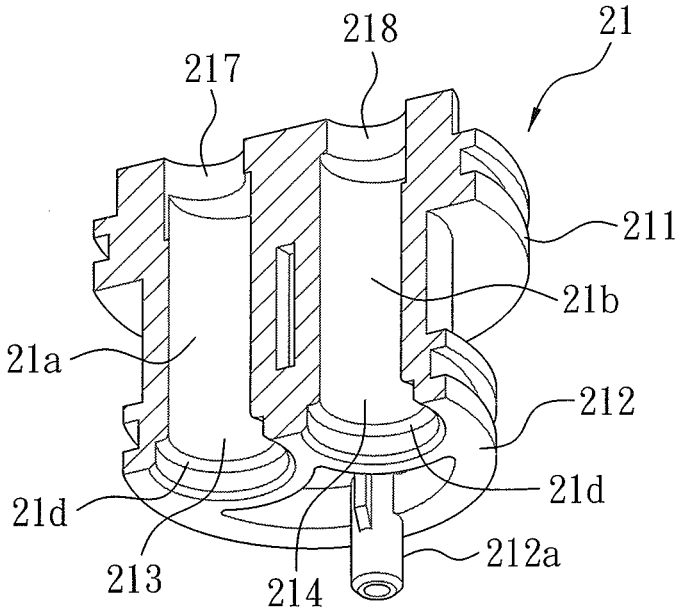
FIG. 8 is still another cross-sectional perspective view showing the assembly of a part of the quick connect faucet according to the first embodiment of the present invention.
Figure 9:
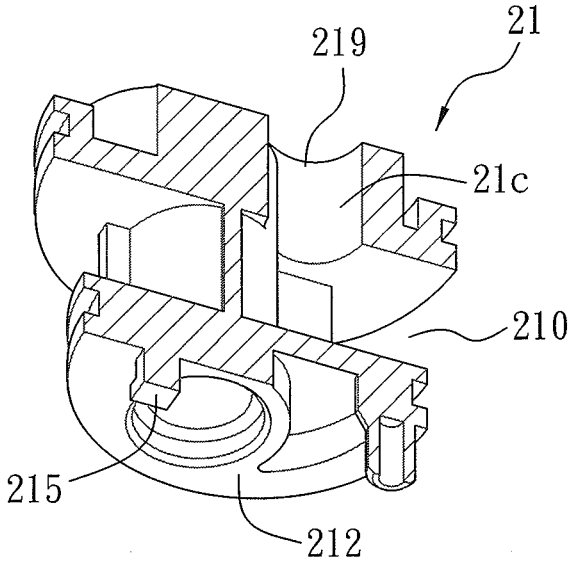
FIG. 9 is another cross-sectional perspective view showing the assembly of a part of the quick connect faucet according to the first embodiment of the present invention.

Each of the cold-water inlet 213 and the hot-water inlet 214 has a defining fringe 21*d*, as illustrated in FIG. 8. The cold-water inflow tube 31 has an extension 303 accommodated in the cold-water inlet 213, and the hot-water inflow tube 32 has an extension 303 housed in the hot-water inlet 214, as shown in FIG. 11. The cold-water inflow tube 31 also has a second locking rib 304 defined between the extension 303 and the peripheral trench 302 of the cold-water inflow tube 31 and contacting with the defining fringe 21*d* of the cold-water inlet 213. The hot-water inflow tube 32 also has a second locking rib 304 defined between the extension 303 and the peripheral trench 302 of the hot-water inflow tube 32 and contacting with the defining fringe 21*d* of the hot-water inlet 214.

With reference to FIG. 11, when connecting the quick connect faucet 1, the cold-water inflow tube 31 and the hot-water inflow tube 32 are individually inserted into the cold-water inlet 213 and the hot-water inlet 214 of the holder 21, and the fastener 22 is slidably retained with the T-shaped locking protrusion 215 of the holder 21 so that the at least two cutouts 221 of the fastener 22 engage with the peripheral trenches 302 of the cold-water inflow tube 31 and the hot-water inflow tube 32 respectively, thus fixing the cold-water inflow tube 31 and the hot-water inflow tube 32 with the holder 21 quickly.

Referring further to FIG. 2, the holder 21 is accommodated in the accommodation groove 13 from the affix orifice 131 of the cylindrical casing 101 so that the first locking rib 211 retains with the first stepped portion 132 of the accommodation groove 13, and the column 212*a* of the bottom fence 212 retains in the guide orifice 135 of the second stepped portion 133.

Thereafter, the mixing valve 23, the affix loop 24, the cap 25, and the handle are connected together, thus connecting the control valve assembly 20 quickly.

When the fastener 22 retains with the holder 21, a gap exists among a bottom of the fastener 22 and tops of the two stop portions 215*b* of the T-shaped locking protrusion 215, hence when the cold-water inflow tube 31 and the hot-water inflow tube 32 are forced by water pressure to push the fastener 22 to move downwardly, the fastener 22 is stopped on the second stepped portion 133 of the accommodation groove 13 securely, as shown in FIGS. 2 and 13, hence the cold-water inflow tube 31 and the hot-water inflow tube 32 are fixed firmly.

With reference to FIGS. 14-17, a quick connect faucet 1*a* of a second embodiment is mounted on a water sink in a kitchen. A difference of the quick connect faucet 1*a* from that of the first embodiment comprises:

a mixing-water conduit 21*c* of a holder 21 having a third outlet 210*a* formed on the bottom fence 212 of the holder 21, as illustrated in FIGS. 18-21.

Figure 17:
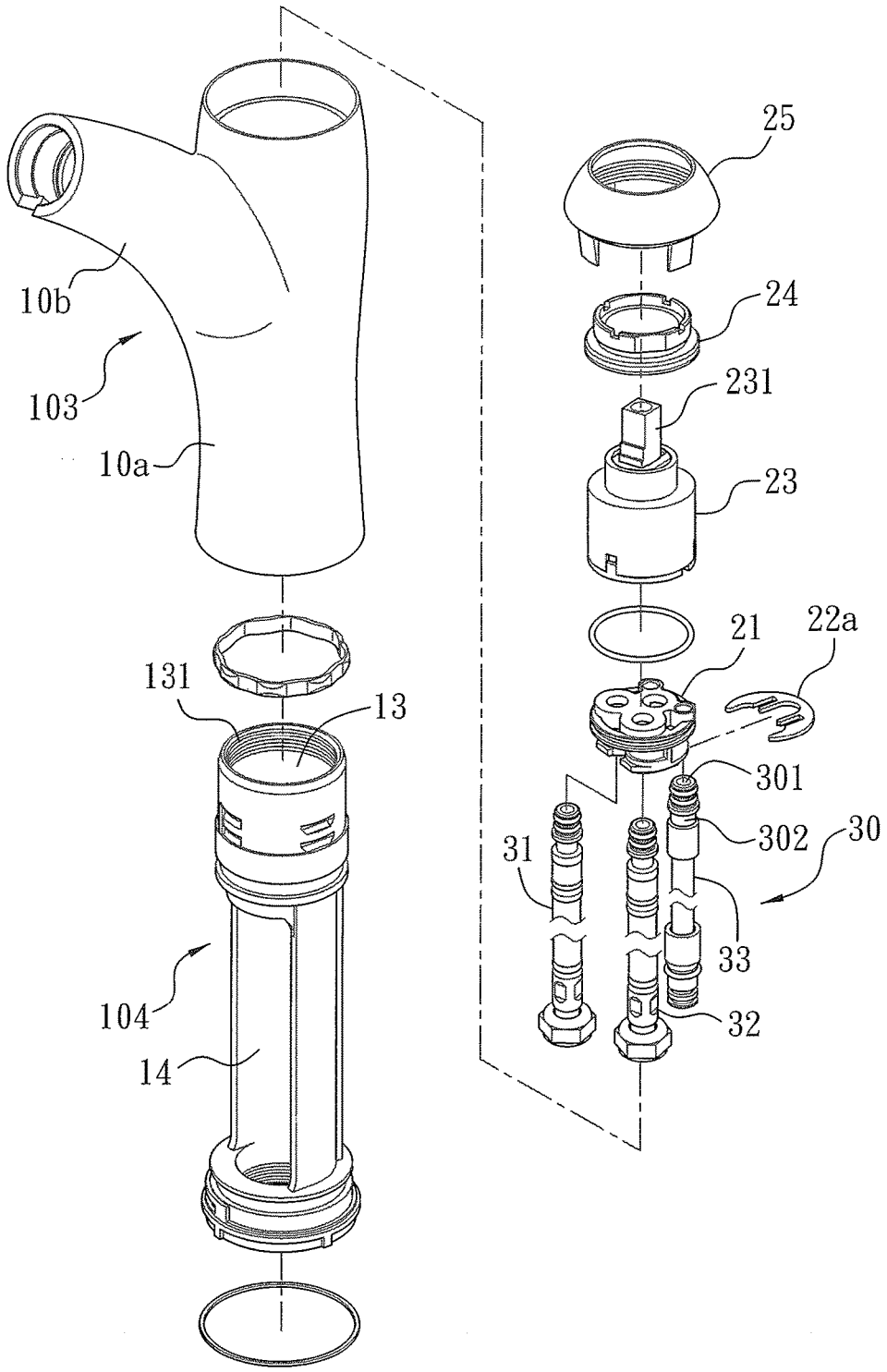
FIG. 17 is a perspective view showing the exploded components of a part of quick connect faucet according to the second embodiment of the present invention.

Referring to FIG. 17, a water supply set 30 includes a mixing-water outflow tube 33 having an outlet segment 301 inserted into the third outlet 210*a* of the holder 21, and the outlet segment 301 of the mixing-water outflow tube 33 has a peripheral trench 302 defined adjacent to an outer wall thereof.

Figure 19:
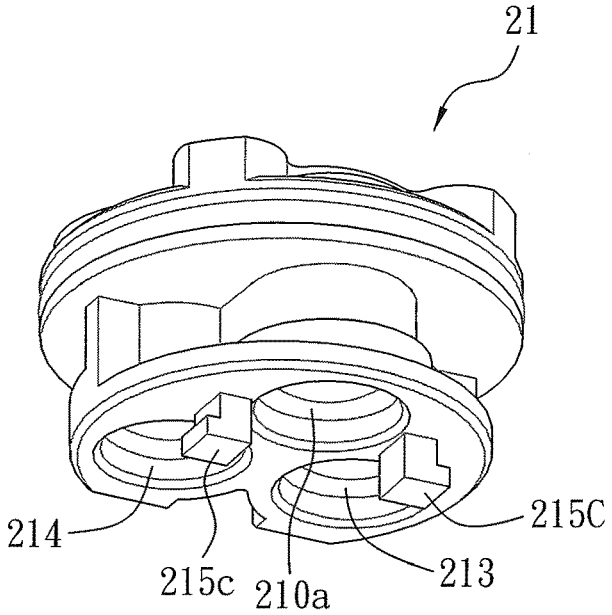
FIG. 19 is still another perspective view showing the assembly of a part of quick connect faucet according to the second embodiment of the present invention.
Figure 20:
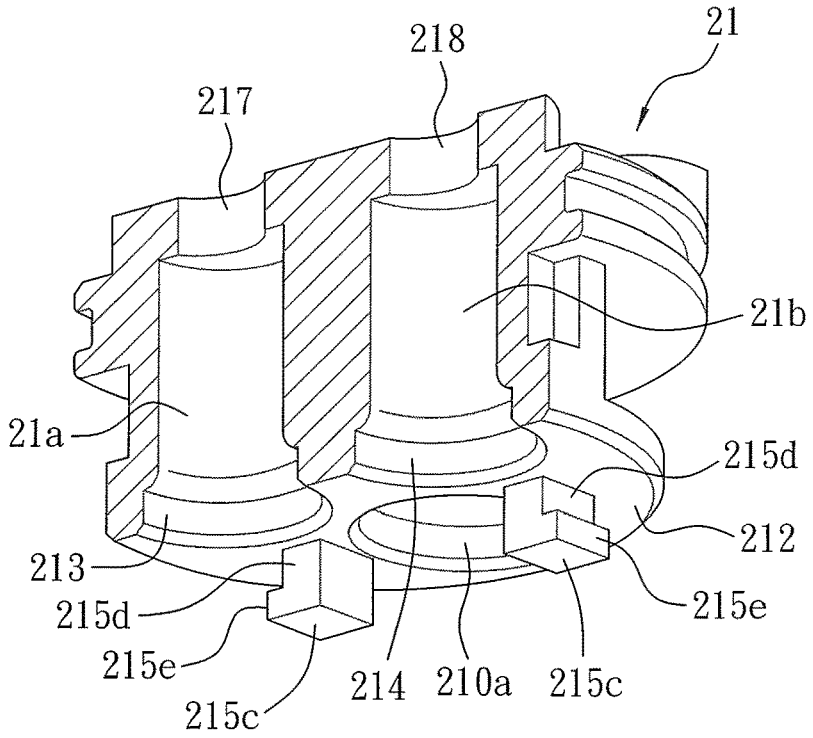
FIG. 20 is a cross-sectional perspective view showing the assembly of a part of the quick connect faucet according to the second embodiment of the present invention.
Figure 21:
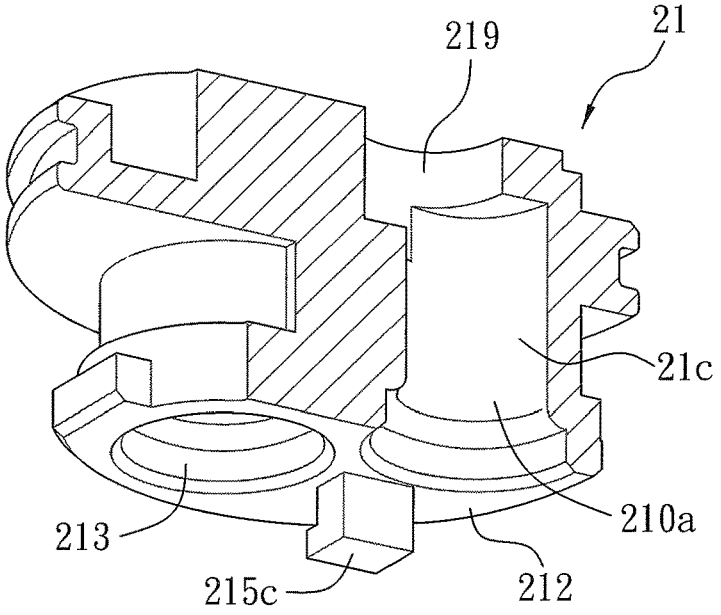
FIG. 21 is another cross-sectional perspective view showing the assembly of a part of the quick connect faucet according to the second embodiment of the present invention.
Figure 22:
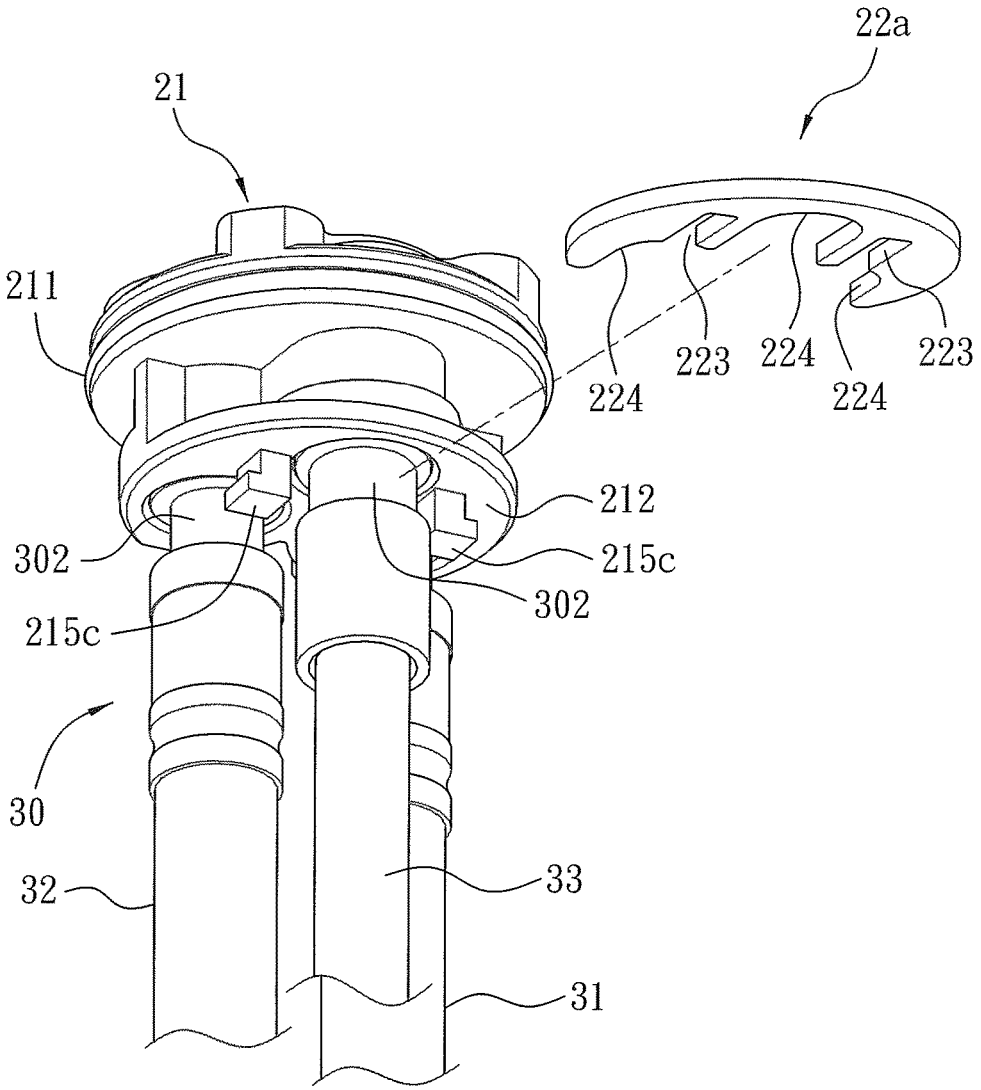
FIG. 22 is a perspective view showing the exploded components of a part of quick connect faucet according to the second embodiment of the present invention.
Figure 23:
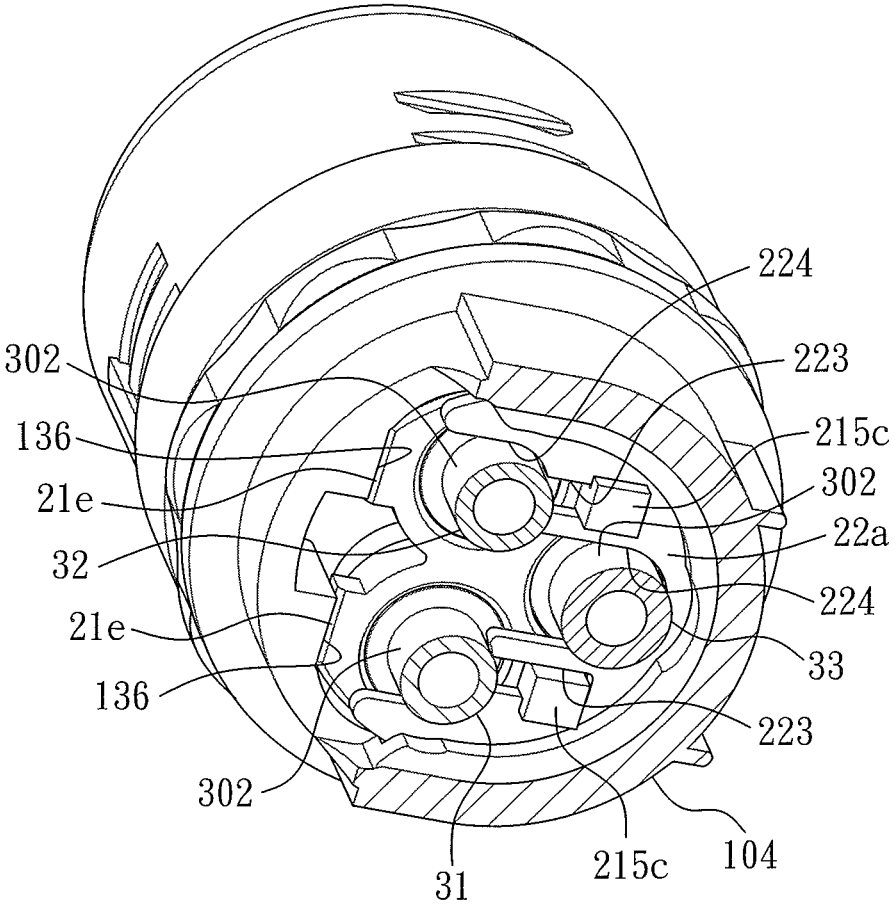
FIG. 23 is also another cross-sectional perspective view showing the assembly of a part of the quick connect faucet according to the second embodiment of the present invention.

As shown in FIGS. 19 and 20, the bottom fence 212 of the holder 21 has two L-shaped locking protrusions 215*c* extending therefrom and located adjacent to the third outlet 210*a*, wherein each of the two L-shaped locking protrusions 215*c* has a connection portion 215*d* extending downwardly from the bottom fence 212 and has a stop portions 215*e* extending horizontally from a distal end of the connection portion 215*d* respectively. As illustrated in FIGS. 22 and 23, a fastener 22*a* has two peripheral slots 223 configured to slidably fit with two connection portions 215*d* of the two L-shaped locking protrusions 215*c* respectively and to be stopped by two stop portions 215*e* of the two L-shaped locking protrusions 215*c*. The fastener 22*a* further has three cutouts 224 which are concaved, wherein one of the three cutouts 224 is defined between the two peripheral slots 223 so as to retain with the peripheral trench 302 of the mixing-water outflow tube 33, and the other two cutouts 224 are located outside the two peripheral slots 223 respectively so as to retain with the peripheral trenches 302 of the cold-water inflow tube 31 and the hot-water inflow tube 32 individually, thus fixing the cold-water inflow tube 31, the hot-water inflow tube 32, and the mixing-water outflow tube 33 with the holder 21.

With reference to FIGS. 14-17, the hollow body 10 includes a shell 103 and a fitting part 104 mounted in the shell 103. The shell 103 has a cylindrical part 10*a* and a tubular part 10*b* extending outwardly from the cylindrical part 10*a*, wherein the cylindrical part 10*a* and the fitting part 104 define the longitudinal chamber 11, the tubular part 10*b* defines the channel 12, a top of the fitting part 104 defines the accommodation groove 13, and the accommodation groove 13 has a through hole 14 extending from a middle of a bottom thereof.

The quick connect faucet 1*a* further comprises a water hose, a spray head, and a counterweight. The water hose is in communication with the mixing-water outflow tube 33 and is connected with the spray head via the mixing-water outflow tube 33, the through hole 14 of the fitting part 104, and the channel 12 of the tubular part 10*b*. The spray head is movably fixed on a water flowing segment of the tubular part 10*b*, and the counterweight is mounted on the water hose so as to move back to an original position. after the spray head is released. Due to the water hose, the spray head, and the counterweight are well-known art, thither remarks are omitted.

Figure 18:
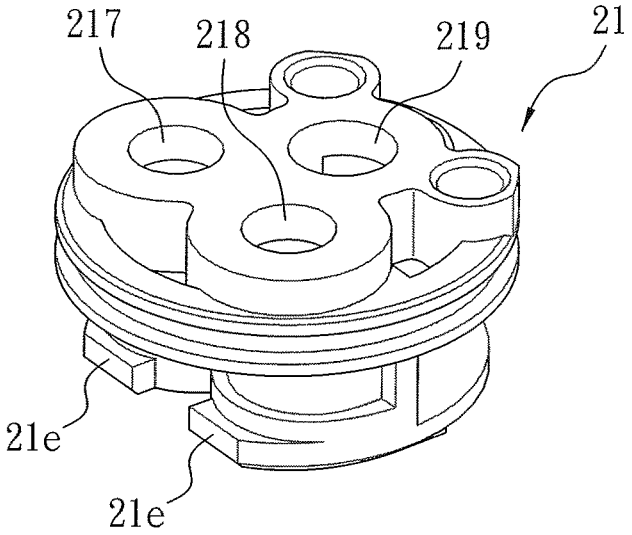
FIG. 18 is also another perspective view showing the assembly of a part of quick connect faucet according to the second embodiment of the present invention.
Figure 24:
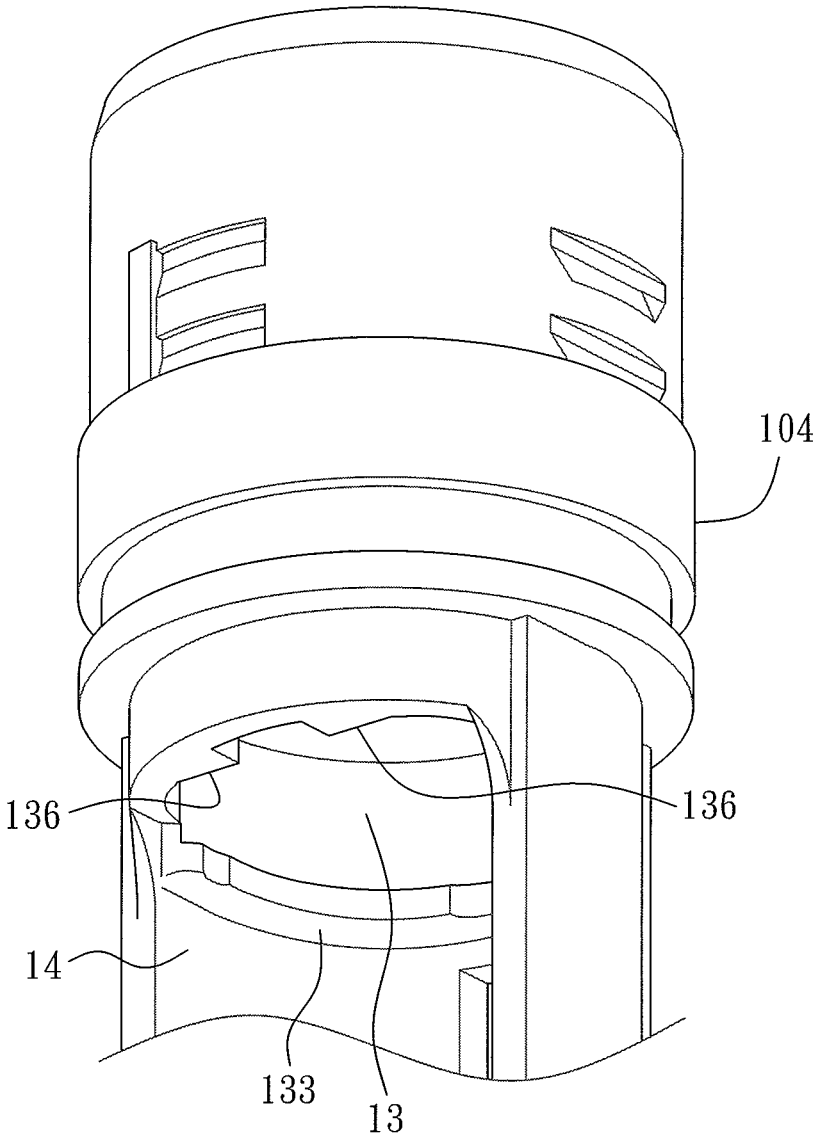
FIG. 24 is another perspective view showing the assembly of a part of the quick connect faucet according to the second embodiment of the present invention.

Referring to FIGS. 23 and 24, the accommodation groove 13 has two spaced planes 136 adjacent to the second stepped portion 133; the holder 21 has two flat defining fringes 21*e* formed on an outer wall thereof proximate to the bottom fence 212, wherein the two flat defining fringes 21*e* are spaced from each other, as shown in FIG. 18, hence the two flat defining fringes 21*e* retain with the two spaced planes 136 individually so as to limit rotation of the holder 21.

Preferably, the mixing-water outflow tube 33 is connected with the third outlet 210*a* of the holder 21.

The two L-shaped locking protrusions 215*c* of the holder 21 engage with the two peripheral slots 223 of the fastener 22*a* respectively so that the fastener 22*a* retains with the holder 21 securely. The one cutout 224 of the fastener 22*a* retains with the mixing-water outflow tube 33 firmly.

Preferably, the two flat defining fringes 21*e* of the holder 21 retain with the two spaced planes 136 of the accommodation groove 13 individually so as to limit rotation of the holder 21.

Accordingly, after the water supply set 30 of the quick connect faucet is inserted into the holder 21, the fastener 22, 22*a* slidably retains with the holder 21 so as to fix the water supply set 30 with the holder 21 easily without using any screw bolts or a rotatory tool.

The holder 21 is integrally injection molded from plastic material so as to reduce fabrication cost and to avoid lead remaining in the quick connect faucet 1, 1*a*.

When the water supply set 30 is forced by the water pressure to push the fastener 22, 22*a* to move downwardly, the fastener 22, 22*a* is stopped on the second stepped portion 133 of the accommodation groove 13 securely. In case the T-shaped locking protrusion 215 or the two L-shaped locking protrusions 215*c* are broken, the fastener 22, 22*a* is limited by the second stepped portion 133 firmly so as to prevent a removal of the water supply set 30.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A quick connect faucet comprising:

a hollow body including a longitudinal chamber defined in the hollow body, and the hollow body including a channel communicating with the longitudinal chamber; the longitudinal chamber having an accommodation groove, and the accommodation groove having a fixing orifice and a first stepped portion radially extending around an inner wall of the accommodation groove;

a control valve assembly including a holder integrally injection molded from plastic material and accommodated in the accommodation groove from the fixing orifice, and the holder having a first locking rib extending outwardly around an outer wall of the holder so as to retain with the first stepped portion, a cold-water conduit configured to flow cold water, a hot-water conduit configured to flow hot water, and a mixing-water conduit configured to flow mixing water of the cold water and the hot water, a bottom fence formed on a bottom of the holder, wherein the cold-water conduit has a cold-water inlet defined on the bottom fence, the hot-water conduit has a hot-water inlet formed on the bottom fence, and the bottom fence has at least one locking protrusion; the control valve assembly includes a fastener slidably retaining with the at least one locking protrusion, wherein the fastener has at least two cutouts;

a water supply set including a cold-water inflow tube and a hot-water inflow tube, each of the cold-water inflow tube and the hot-water inflow tube having an outlet segment, wherein an outlet segment of the cold-water inflow tube is inserted into the cold-water inlet, and an outlet segment of the hot-water inflow tube is inserted into the hot-water inlet, wherein the outlet segment of the cold-water inflow tube has a peripheral trench defined on an outer wall of the cold-water inflow tube, and the outlet segment of the hot-water inflow tube has a peripheral trench defined on an outer wall of the hot-water inflow tube, hence the peripheral trenches of the cold-water inflow tube and the hot-water inflow tube retain with the at least two cutouts of the fastener respectively so as to fix the cold-water inflow tube and the hot-water inflow tube with the holder;

wherein the holder has a top fence defined on a top of the holder, wherein the cold-water conduit has a first outlet formed on the top fence, the hot-water conduit has a second outlet formed on the top fence, and the mixing-water conduit has a third outlet formed on the top fence; the mixing-water conduit has at least two fourth outlets formed on an outer wall of the holder;

wherein the bottom fence of the holder has a T-shaped locking protrusion extending from a center of the bottom fence and located adjacent to the cold-water inlet and the hot-water inlet, wherein the T-shaped locking protrusion has a connection portion extending downwardly and has two stop portions extending horizontally from two sides of a distal end of the connection portion respectively; the fastener has a central slot configured to slidably fit with the connection portion of the T-shaped locking protrusion, and the fastener is stopped by the two stop portions so as to fix with the fastener; the at least two cutouts are concaved and located on two sides of the central slot respectively so as to retain with the peripheral trenches of the cold-water inflow tube and the hot-water inflow tube.

2. The quick connect faucet as claimed in claim 1, wherein the control valve assembly further includes a mixing valve, an affix loop, a cap, and a handle; the mixing valve is housed in the accommodation groove from the fixing orifice and communicates with the holder, and the mixing valve has a rotary shaft; the affix loop is screwed with the fixing orifice of the hollow body so as to fix the mixing valve in the accommodation groove; the cap covers the fixing orifice; and the handle is connected with the rotary shaft of the mixing valve.

3. The quick connect faucet as claimed in claim 1, wherein the accommodation groove further has a second stepped portion radially extending around the inner wall of the accommodation groove away from the affix orifice; the fastener is opposite to the second stepped portion and is limited by the second stepped portion.

4. The quick connect faucet as claimed in claim 3, wherein the second stepped portion has a guide orifice; the bottom fence of the holder has a column extending outwardly and retained in the guide orifice so as to fix the holder.

5. The quick connect faucet as claimed in claim 1, wherein the hollow body includes a cylindrical casing and an outflow tube extending outwardly from an outer wall of the cylindrical casing; the cylindrical casing has the longitudinal chamber and the accommodation groove; the outflow tube has the channel; and the cylindrical casing has a through orifice formed on an inner wall thereof opposite to the accommodation groove and communicating with the at least two fourth outlets so as to guide the mixing water to the channel.

6. The quick connect faucet as claimed in claim 1, wherein each of the cold-water inlet and the hot-water inlet has a defining fringe; the cold-water inflow tube has an extension accommodated in the cold-water inlet, and the hot-water inflow tube has an extension housed in the hot-water inlet; the cold-water inflow tube also has a second locking rib defined between the extension and the peripheral trench of the cold-water inflow tube and contacting with the defining fringe of the cold-water inlet; the hot-water inflow tube also has a second locking rib defined between the extension and the peripheral trench of the hot-water inflow tube and contacting with the defining fringe of the hot-water inlet.

7. A quick connect faucet comprising:

a hollow body including a longitudinal chamber defined in the hollow body, and the hollow body including a channel communicating with the longitudinal chamber; the longitudinal chamber having an accommodation groove, and the accommodation groove having a fixing orifice and a first stepped portion radially extending around an inner wall of the accommodation groove;

a control valve assembly including a holder integrally injection molded from plastic material and accommodated in the accommodation groove from the fixing orifice, and the holder having a first locking rib extending outwardly around an outer wall thereof so as to retain with the first stepped portion, a cold-water conduit configured to flow cold water, a hot-water conduit configured to flow hot water, and a mixing-water conduit configured to flow mixing water of the cold water and the hot water, a bottom fence formed on a bottom of the holder, wherein the cold-water conduit has a cold-water inlet defined on the bottom fence, the hot-water conduit has a hot-water inlet formed on the bottom fence, and the bottom fence has at least one locking protrusion extending therefrom; the control valve assembly includes a fastener slidably retaining with the at least one locking protrusion, wherein the fastener has at least two cutouts;

a water supply set including a cold-water inflow tube and a hot-water inflow tube, each of the cold-water inflow tube and the hot-water inflow tube having an outlet segment, wherein an outlet segment of the cold-water inflow tube is inserted into the cold-water inlet, and an outlet segment of the hot-water inflow tube is inserted into the hot-water inlet, wherein the outlet segment of the cold-water inflow tube has a peripheral trench defined on an outer wall of the cold-water inflow tube, and the outlet segment of the hot-water inflow tube has a peripheral trench defined on an outer wall of the hot-water inflow tube, hence the peripheral trenches of the cold-water inflow tube and the hot-water inflow tube retain with the at least two cutouts of the fastener respectively so as to fix the cold-water inflow tube and the hot-water inflow tube with the holder;

wherein the holder has a top fence defined on a top of the holder, wherein the cold-water conduit has a first outlet formed on the top fence, the hot-water conduit has a second outlet formed on the top fence, and the mixing-water conduit has a third outlet formed on the top fence; the mixing-water conduit has a third outlet formed on the bottom fence of the holder;

wherein the water supply set further includes a mixing-water outflow tube having an outlet segment inserted into the third outlet of the holder, and the outlet segment of the mixing-water outflow tube has a peripheral trench defined adjacent to an outer wall thereof; the bottom fence of the holder has two L-shaped locking protrusions extending therefrom, wherein each of the two L-shaped locking protrusions has a connection portion extending downwardly from the bottom fence and has a stop portions extending horizontally from a distal end of the connection portion respectively; the fastener has two peripheral slots configured to slidably fit with two connection portions of the two L-shaped locking protrusions respectively and to be stopped by two stop portions of the two L-shaped locking protrusions; the fastener further has three cutouts which are concaved, wherein one of the three cutouts is defined between the two peripheral slots so as to retain with the peripheral trench of the mixing-water outflow tube, and the other two cutouts are located outside the two peripheral slots respectively so as to retain with the peripheral trenches of the cold-water inflow tube and the hot-water inflow tube individually, thus fixing the cold-water inflow tube, the hot-water inflow tube, and the mixing-water outflow tube with the holder.

8. The quick connect faucet as claimed in claim 7, wherein the hollow body includes a shell and a fitting part mounted in the shell; the shell has a cylindrical part and a tubular part extending outwardly from the cylindrical part, wherein the cylindrical part and the fitting part define the longitudinal chamber, the tubular part defines the channel, a top of the fitting part defines the accommodation groove, and the accommodation groove has a through hole extending from a bottom of the accommodation groove.

9. The quick connect faucet as claimed in claim 8 further comprising a water hose, a spray head, and a counterweight; the water hose is in communication with the mixing-water outflow tube and is connected with the spray head via the mixing-water outflow tube, the through hole of the fitting part, and the channel of the tubular part; the spray head is movably fixed on a water flowing segment of the tubular part; and the counterweight is mounted on the water hose so as to move back to an original position.

10. The quick connect faucet as claimed in claim 7, wherein the two L-shaped locking protrusions are located adjacent to the third outlet.

11. The quick connect faucet as claimed in claim 7, wherein the accommodation groove has two spaced planes adjacent to the second stepped portion; and the holder has two flat defining fringes formed on an outer wall thereof proximate to the bottom fence, hence the two flat defining fringes retain with the two spaced planes individually so as to limit rotation of the holder.

12. The quick connect faucet as claimed in claim 7, wherein the control valve assembly further includes a mixing valve, an affix loop, a cap, and a handle; the mixing valve is housed in the accommodation groove from the fixing orifice and communicates with the holder, and the mixing valve has rotary shaft; the affix loop is screwed with the fixing orifice of the hollow body so as to fix the mixing valve in the accommodation groove; the cap covers the fixing orifice; and the handle is connected with the rotary shaft of the mixing valve.

13. The quick connect faucet as claimed in claim 7, wherein the accommodation groove further has a second stepped portion radially extending around the inner wall of the accommodation groove away from the affix orifice; the fastener is opposite to the second stepped portion and is limited by the second stepped portion.

* * * * *